US005562488A

United States Patent [19]

Neiser et al.

[11] Patent Number: 5,562,488

[45] Date of Patent: Oct. 8, 1996

[54] MODULAR OUTLET ASSEMBLY

[76] Inventors: Gabe Neiser, 12 Gray Ave.; Theodore Simon, 35 Melrose Rd., both of Dix Hills, N.Y. 11746; Barry Schweiger, 9 Richborne La., Melville, N.Y. 11747

[21] Appl. No.: 396,663

[22] Filed: Mar. 1, 1995

Related U.S. Application Data

[63] Continuation-in-part of Ser. No. 229,207, Aug. 18, 1994, abandoned.

[51] Int. Cl.[6] ..... H01R 35/02

[52] U.S. Cl. ..... 439/501; 439/652; 439/373

[58] Field of Search ..... 242/379; 200/51 R, 200/51.03, 51.05, 51.11; 439/501, 4, 652, 651, 373, 536

[56] References Cited

U.S. PATENT DOCUMENTS

| | | | |
|---|---|---|---|
| D. 258,429 | 3/1981 | Buckler | D13/28 |
| 3,775,729 | 11/1973 | Casper | 439/459 |
| 3,815,078 | 6/1974 | Fedrick | 439/501 |
| 3,838,381 | 9/1974 | De Villemeur | 439/346 |
| 3,938,068 | 2/1976 | Hagan | 439/622 |
| 4,083,621 | 4/1978 | Davidson et al. | 439/501 |
| 4,934,962 | 6/1990 | Luu et al. | 439/651 |
| 5,236,371 | 8/1993 | Matthis | 439/501 |
| 5,269,695 | 12/1993 | Opel | 439/654 |

FOREIGN PATENT DOCUMENTS 1217563 12/1959 France .

*Primary Examiner*—Gary F. Paumen
*Attorney, Agent, or Firm*—Collard & Roe, P.C.

[57] ABSTRACT

A modular assembly for electrically coupling to a duplex wall socket having a pair of outlets. A first modular unit has a first set of electrical prongs for inserting into one of the outlets. The first set of electrical prongs power a large number of receptacles provided on the first modular unit. An aperture is formed within the first modular unit to expose the other outlet. A second modular unit having a second set of electrical prongs is plugged through the aperture into the second outlet. The second modular unit includes a reel mounted extension cord with additional receptacles on the end of the extension cord. When used together, the modular units matingly engage to provide a stabilized assembly with a large number of local and remote receptacles.

16 Claims, 2 Drawing Sheets

MODULAR OUTLET ASSEMBLY

CROSS REFERENCE TO RELATED APPLICATIONS

This is a Continuation-In-Part of our co-pending application Ser. No. 08/229,207, filed Apr. 18, 1994, entitled "Combined Outlet and Retractable Extension Cord."

BACKGROUND OF THE INVENTION

1. Field of the Invention

The present invention relates to a modular outlet assembly. More particularly, it relates to a first modular component which provides a plurality of receptacles closely positioned to a wall socket and a second modular component providing at least one receptacle selectively positionable locally or remotely from the wall socket.

2. The Prior Art

Numerous electrical connectors are disclosed in the prior art for securing a plug to a wall socket or reconfiguring the wall socket. An example of the prior art devices is set forth in the following patents: U.S. Pat. No. 3,755,729 to Casper; U.S. Pat. No. 3,838,381 to De Villemeur; U.S. Pat. No. 3,938,068 to Hagan; U.S. Pat. No. 4,934,962 to Luu et al.; and U.S. Pat. No. 5,269,695 to Opel.

Although the above noted prior art provides solutions to a limited number of problems, serious drawbacks remain. For example, the above noted prior art does not provide any electrical receptacles remote from the wall socket. As a result, a separate extension cord is required. An attempt to overcome this and other drawbacks can be seen from the following patents: French Patent 1,2175,563 to Muller; U.S. Pat. No. 3,815,078 to Fedrick; U.S. Pat. No. 4,083,621 to Davidson et al.; and U.S. Pat. No. 5,236,371 to Matthis. Although these patents have retractable extension cords incorporated therein, certain drawbacks still exist. First, because of the space occupied by the reel, an insufficient number of receptacles are provided in place of the ones occupied by the device. In addition, these patents do not provide a plurality of outlets local to the wall receptacle with the possibility of using the outlet on the reel at a separate location. Accordingly, it would be desirable to provide a modular system where a plurality of local outlets are provided with the reel mounted extension cord being selectively utilized with the local outlet or separately.

SUMMARY OF THE INVENTION

It is an object of the present invention to overcome the drawbacks of the prior art and to provide a plurality of local outlets and extension cord mounted outlets which can be used independently of each other and in combination.

It is a further object of the present invention to provide a plurality of local outlets coupled to one of the wall sockets while leaving the second wall socket available and accessible.

It is yet another object of the present invention to provide an extension cord mounted receptacle which is powered off of the available and accessible second wall socket.

These and other related objects are achieved according to the invention by an apparatus for electrically coupling to a duplex wall socket having a pair of outlets. The apparatus comprises a first unit including a base having a front surface and a rear surface. A first set of electrical prongs extends from the rear surface for insertion to one of the outlets for detachably mounting the first modular unit on the socket.

Receptacle block means are mounted on the front surface and electrically coupled to the first set of electrical prongs. An aperture is formed within the base and positioned relative to the first set of electrical prongs to expose the other of the outlets for electrically coupling to an electrical device. The receptacle block means comprises a receptacle block integrally formed with the base. The receptacle block includes a top surface with a receptacle, a front surface with one or more receptacles, a side surface with one or more receptacles, and a bottom surface with a receptacle. The base is planar and includes two spaced side walls extending between the front surface and the rear surface. One receptacle block is mounted adjacent each of the two spaced side walls.

The electrical device comprises a second unit including a housing with a back surface. A platform is integrally formed on the back surface and is configured and dimension to fit within the aperture. A second set of electrical prongs extends from the platform for insertion into the other of the outlets to power the second unit. The second set of electrical prongs are inserted into the other of the outlets with the second unit being stabilized by the engaging relationship of the platform fitting within the aperture and the housing sandwiched between the receptacle blocks. The engaging relationship between the first unit and the second unit comprises mating contours on the units.

The second unit further includes a reel rotatably supported in the housing and an extension cord wound on said reel. Electrical socket means are provided on one end of the extension cord, whereby the cord may be pulled from housing to dispose the electrical socket means at locations remote from the second unit. The second unit further includes a switch connected between the second set of electrical prongs and the extension cord for selectively powering the electrical socket means. A circuit breaker is also connected between the second set of electrical prongs and the extension cord for a resettably limiting the current drawn from the electrical socket means. The second unit further includes a safety lock for releasably locking electrical socket means to the housing when the extension cord is fully wound on the reel and retracted within the housing. The electrical socket means comprises an available electrical socket when the extension cord is retracted and the safety lock is locked and a pull tab for conveniently removing the electrical socket.

The reel is rotatably biased into a retracted position. Locking means selectively locks the reel in various extended positions and is released to retract the extension cord under the rotational bias. One of the receptacle blocks is shorter than the length of the side wall onto which it is mounted. The housing of the second unit includes an arm that extends adjacent the shorter receptacle block out to the corresponding side wall. The extension cord extends out of the housing through the arm. In the retracted position, the available electrical socket is aligned with the receptacle on the front surface of the shorter receptacle block. A bore is provided through each of the modular units. Each bore is adapted to receive a screw for engaging a threaded hole on the duplex wall socket. The first unit and the modular unit are adapted to be independently controlled by a wall switch selectively coupled to one of the outlets, the other of the outlets, and the pair of outlets. A resilient cushion extends about the periphery of the rear surface of the first unit.

Alternatively, the apparatus for electrically coupling to a wall socket comprises a housing and electrical prongs extending from the housing for mounting the housing on the wall socket. A reel is rotatably supported within the housing and rotatably biased into a retracted position. An extension cord is wound on the reel and coupled to the electrical prongs. An electrical socket is disposed on one end of the extension cord. One of the following features may optionally be provided on the second unit. A switch is mounted on the housing and coupled between the electrical prongs and the extension cord for selectively powering the electrical socket. A circuit breaker is mounted on the housing and coupled between the electrical prongs and the extension cord for resettably limiting the current supplied to the electrical socket. A safety lock is provided for releasably locking the electrical socket to the housing when the extension cord is retracted. Surge protection means is coupled between the electrical prongs and the extension cord for limiting electrical surges to the electrical socket. Locking means are provided for selectively locking the reel in various extended positions. The reel locking means is released to retract the extension cord.

In a further embodiment, there is provided a modular assembly for electrically coupling to a duplex wall socket having a pair of outlets. The assembly comprises a first modular unit having a first set of electrical prongs for detachably mounting the first modular unit to one of the pair of outlets and first receptacle means electrically coupled to the first set of electrical prongs. A second modular unit has a second set of electrical prongs for detachably mounting the second modular unit to the other of the pair of outlets. Second remote receptacle means are coupled to the second pair of electrical prongs. Connection means are provided for connecting both of the modular units to the wall socket whereby the modular units are braced against each other to provide a stabilized assembly with a plurality of fixed and remote receptacles.

BRIEF DESCRIPTION OF THE DRAWINGS

Other objects and features of the present invention will become apparent from the following detailed description considered in connection with the accompanying drawings which discloses an embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
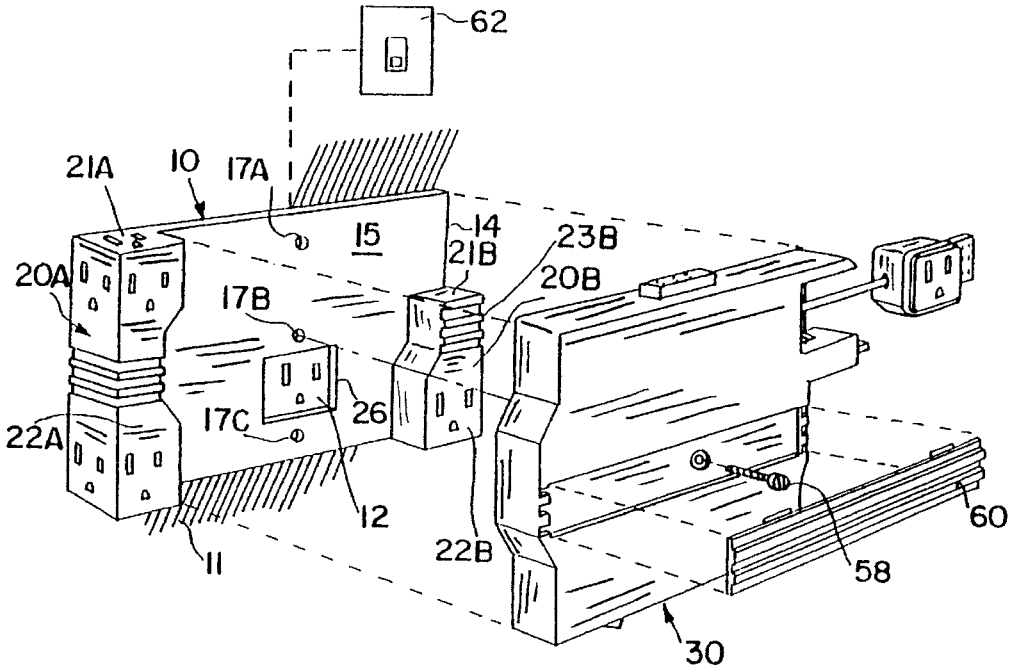
FIG. 1 is a front top left side perspective view of two separate modular units according to the invention.

Turning now in detail to the drawings and in particular FIG. 1, there is shown a first modular unit 10 and a second modular unit 30 which are plugged into a wall socket 12 for powering the respective units and mounting them adjacent a wall 11. Modular units 10 and 30 may be used separately or together.

Figure 2:
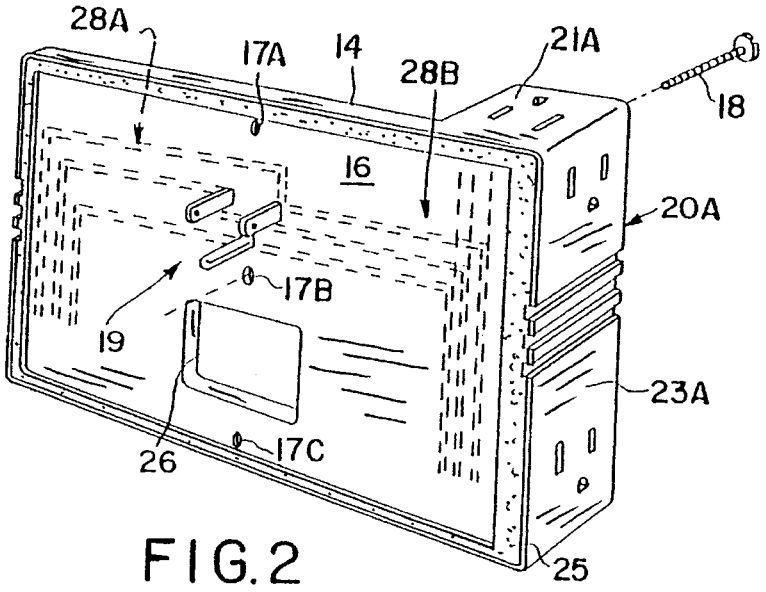
FIG. 2 is a rear top left side elevational view of the first modular unit.
Figure 3:
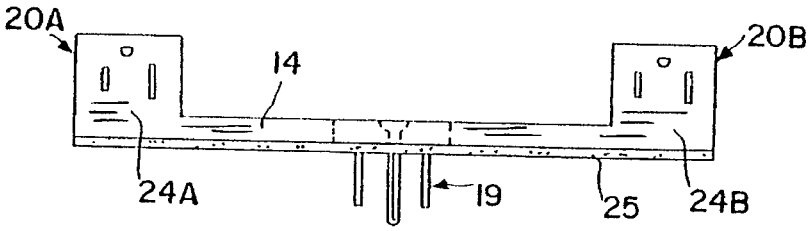
FIG. 3 is a bottom plan view of the first modular unit.
Figure 4:
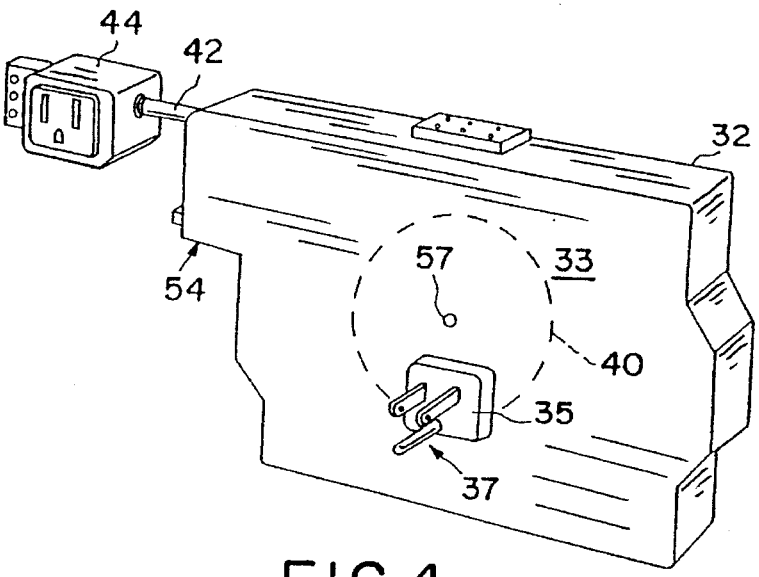
FIG. 4 is a rear top left side elevational view of the second modular unit.
Figure 5:
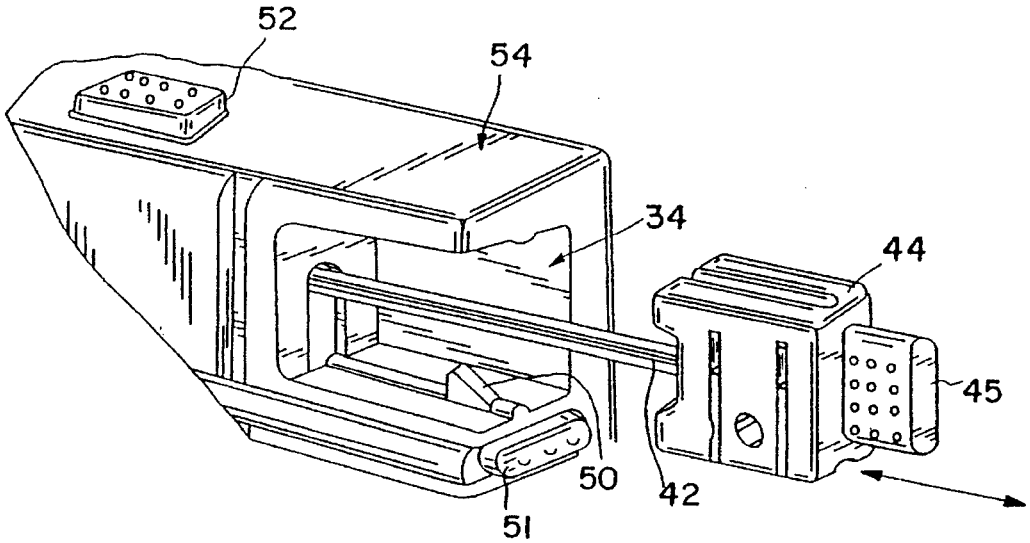
FIG. 5 is a fragmentary perspective view of the extension cord and electrical socket from the second modular unit.
Figure 6:
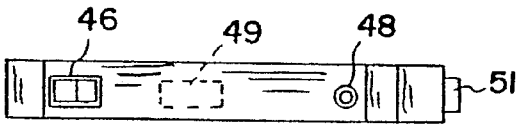
FIG. 6 is a bottom plan view of the second modular unit.

Referring now to FIGS. 1, 2, and 3, first modular unit 10 is shown having a base 14 with a front surface 15 and a rear surface 16. Electrical prongs 19 extend outwardly from rear surface 16. A set of counter-sunk or counter-bored holes 17A, 17B and 17C is provided for securely attaching first modular unit 10 to wall socket 12 or the electrical junction box that houses wall socket 12. Hole 17B is utilized by removing the existing screw and wall plate from wall socket 12. Electrical prongs 19 are then plugged into the top outlet of wall socket 12. A screw 18 then extends through hole 17B and into the threaded hole of wall socket 12 which previously held the screw for the cover plate. An aperture 26 then exposes the other outlet of wall socket 12. Thus, one outlet of wall socket 12 is occupied with electrical prongs 19 to power the first modular unit, with the second outlet being available and accessible via aperture 26. It should be understood that the lower outlet may be used to power first modular unit 10 with aperture 26 exposing the upper outlet. A resilient cushion or insulation layer 25 is optionally provided about the periphery of rear surface 16. Cushion 25 prevents first unit 10 from rocking back and forth, particularly if the wall is uneven. In addition, cushion 25 helps reduce drafts which may be present around wall socket 12, especially if the socket cover plate is removed before installing first unit 10.

Alternatively, first modular unit 10 may be secured as follows. After the cover plate is removed from wall socket 12, the two screws securing the wall socket to the junction box are removed. Similar screws are then inserted through holes 17A and 17C to secure first modular unit 10 directly to the junction box with wall socket 12 clamped therebetween. A series of electrically conducted bars 28A and 28B extend from electrical prongs 19, within base 14 to receptacle blocks 20A and 20B. These receptacle blocks include top surfaces 21A and 21B, front surfaces 22A and 22B, side surfaces 23A and 23B, and bottom surfaces 24A and 24B. Each of these surfaces may be blank or equipped with one or more electrical receptacles. Surge protection is optionally provided to these electrical receptacles.

Referring now to FIGS. 1, 4, 5 and 6, second modular unit 30 is shown having a housing 32 with a back surface 33. A platform 35 extends outwardly from back surface 33 with electrical prongs 37 extending outwardly therefrom. Platform 35 is configured and dimensioned to fit snugly within aperture 26 with electrical prongs 37 plugging into the remaining outlet of wall socket 12. Mating contours on housing 32 and receptacle blocks 20A and 20B stabilize the two modular units. Housing 32 is sandwiched between receptacle blocks 20A and 20B. A reel 40 is disposed within housing 32 upon which an extension cord 42 is wound. At the free end of extension cord 42, electrical socket means 44 are provided with receptacles on a side or two sides thereof. Extension cord 42 is electrically coupled to electrical prongs 37 in a manner well known to those skilled in the art.

Housing 32 is provided with an aperture or opening 34 which receives electrical socket means 44 when extension cord 42 is fully retracted. A switch 46, a circuit breaker 48 and surge protection means 49 are coupled between electrical prongs 37 and extension cord 42. Switch 46 allows power to electrical socket means 44 to be selectively switched on and off. Circuit breaker 48 interrupts power to electrical socket means 44 when the current exceeds a predefined limit. Circuit breaker 48 is then depressed to reset. Surge protection means 49 limits voltage spikes exceeding a predetermined limit.

When extension cord 42 is fully retracted, electrical socket means 44 is disposed within opening 34. A safety lock 50 engages the bottom of electrical socket means 44 to prevent it from being withdrawn. A release lever 51 must be depressed to retract safety lock 50 and withdraw electrical socket means 44 by tab 45. Reel 40 is continuously biased to retract extension cord 42. Reel 40 is selectively held in position by reel locking means 52. Reel locking means 52 is depressed to retract extension cord 42 upon reel 40. An arm 54 extends off the top corner of housing 32. Arm 54 is located above receptacle block 20B when second modular unit 30 is mounted on first modular unit 10. A bore 57 is centrally positioned on housing 32. A screw 58 passes through bore 57, through bore 17B to secure the modular units to wall socket 12. A decorative cover 60 is provided to cover screw 58.

First modular unit 10 as shown occupies a single wall outlet, leaves the second wall outlet accessible and available and provides a large number of additional receptacles. The receptacles on top surface 21A, side surfaces 23A and 23B and bottom surfaces 24A and 24B are positioned transversely to the existing wall socket 12. Items plugged into these receptacles extend parallel to the wall, which is particularly useful when furniture or other items are pressed close to the wall. By adding second modular unit 30, an additional electrical socket is provided, even when the extension cord is fully retracted on the reel. By depressing release 51 and pulling out the extension cord, a total of one or two sockets are now available to be positioned remotely from wall socket 12.

In addition to switch 46, a wall switch 62 may be selectively connected to either or both outlets of wall socket 12 as is known to those skilled in the art. Wall switch 62 could control first modular unit 10, second modular unit 30, or both. This will allow the wall switch to control the outlets on receptacle blocks 20A and 20B with switch 46 controlling electrical socket means 44. Wall switch 62 could also control the entire wall socket 12 or simply the lower wall socket, if, for example, switch 46 is obscured by furniture. It should be understood that first modular unit 10 may be used as a separate unit to simply provide additional outlets locally to wall socket 12. Second modular unit 30 may also be used separately to provide local or remote outlets with switch, circuit breaker, and/or surge protection options. Modular units 10 and 30 may be combined to provide all of these various features in a single location.

While only a single embodiment of the present invention have been shown and described, it is to be understood that many changes and modifications may be made thereunto without departing from the spirit and scope of the invention as defined in the appended claims.

What is claimed is:

1. An apparatus for electrically coupling to a duplex wall socket having a pair of outlets, the apparatus comprising:

a first unit including:

(a) a base having a front surface and a rear surface;

(b) a first set of electrical prongs extending from said rear surface for inserting into one of the outlets for detachably mounting said first unit on the socket;

(c) receptacle block means mounted on said front surface and electrically coupled to said first set of electrical prongs said receptacle block means adapted to receive at least one pronged electrical plug therein; and (d) an aperture formed within said base and positioned relative to said first set of electrical prongs to expose the other of the outlets for electrically coupling to an electrical device.

2. The apparatus as claimed in claim 1, wherein said receptacle block means comprises a receptacle block integrally formed with said base, said receptacle block including a top surface with an electrical receptacle, a front surface with an electrical receptacle, a side surface with an electrical receptacle and a bottom surface with an electrical receptacle.

3. The apparatus as claimed in claim 2, wherein said base is a planar base and includes two side walls extending between said front surface and said rear surface, wherein said receptacle block means comprises a further receptacle block, with a respective one of the receptacle blocks being mounted adjacent each of said two side walls.

4. The apparatus as claimed in claim 3, wherein the electrical device comprises a second unit including:

(a) a housing having a back surface;

(b) a platform integrally formed on said back surface configured and dimensioned to fit within the aperture; and (c) a second set of electrical prongs extending from said platform for insertion into the other of the outlets to power said second unit;

wherein said second set of electrical prongs are inserted into the other of the outlets with said second unit being stabilized by the engaging relationship of said platform fitting within the aperture and said housing sandwiched between the receptacle blocks.

5. The apparatus as claimed in claim 4, wherein the engaging relationship between said first unit and said second unit comprises mating contours on said receptacle blocks and said second unit.

6. The apparatus as claimed in claim 5, wherein said second unit further includes:

(a) a reel rotatably supported within said housing;

(b) an extension cord wound on said reel;

(c) electrical socket means on one end of said extension cord, whereby the cord may be pulled from the housing to dispose said electrical socket means at locations remote from said second unit.

7. The apparatus as claimed in claim 6, wherein said second unit further includes:

(a) a switch connected between said second set of electrical prongs and said extension cord for selectively powering said electrical socket means;

(b) a circuit breaker connected between said second set of electrical prongs and said extension cord for resettably limiting the current drawn from said electrical socket means.

8. The apparatus as claimed in claim 7, wherein said second unit further includes:

a safety lock for releasably locking said electrical socket means to said housing when said extension cord is fully wound on said reel and retracted within said housing;

wherein said electrical socket means comprises an available electrical socket when said extension cord is retracted and said safety lock is locked.

9. The apparatus as claimed in claim 8, wherein said reel is biased into retracted position;

wherein said second unit includes reel locking means for selectively locking said reel with said extension cord in various extended positions, said reel locking means being released to retract said extension cord.

10. The apparatus as claimed in claim 9, wherein of the receptacle block is shorter than the length of the side wall onto which it is mounted;

wherein said housing of said second unit includes an arm that extends adjacent the one receptacle block to the corresponding side wall.

11. The apparatus as claimed in claim 10, wherein said extension cord extends out of housing through said arm.

12. The apparatus as claimed in claim 11, wherein in said retracted position said available electrical socket is aligned with a receptacle on a front surface of said shorter block.

13. The apparatus as claimed in claim 12, comprising a bore through each of said units, each bore is adapted to receive a screw for engaging a threaded hole on the duplex wall socket.

14. The apparatus as claimed in claim 13, wherein said first unit and said second unit are adapted to be independently controlled by a wall switch selectively coupled to one of the outlets, the other of the outlets, and the pair of outlets.

15. The apparatus as claimed in claim 3, wherein said base includes a resilient cushion extending about a periphery of said rear surface.

16. A modular assembly electrically coupled to a duplex wall socket having a pair of outlets, the assembly comprising:

a first modular unit having a first set of electrical prongs detachably mounting said first modular unit to one of said pair of outlets, and first receptacle means electrically coupled to said first set of electrical prongs, said first receptacle means adapted to receive at least one pronged electrical plug therein;

a second modular unit having a second set of electrical prongs for detachably mounting said second modular unit to the other of said pair of outlets, and second remote receptacle means coupled to said second set of electrical prongs, said second remote receptacle means adapted to receive a pronged electrical plug therein;

means for connecting both of said modular units to the wall socket whereby the modular units are braced against each other to provide a stabilized assembly.

* * * * *

UNITED STATES PATENT AND TRADEMARK OFFICE

CERTIFICATE OF CORRECTION

PATENT NO. : 5,562,488

DATED : October 8, 1996

INVENTOR(S) : Gabe Neiser et al.

It is certified that error appears in the above-identified patent and that said Letters Patent are hereby corrected as shown below:

Title page, item [63], change "Aug. 18, 1994" to –Apr. 18, 1994–.

Signed and Sealed this

Twenty-first Day of January, 1997

*Attest:*

Bruce Lehman

BRUCE LEHMAN

*Attesting Officer*

*Commissioner of Patents and Trademarks*